US012656079B2

(12) United States Patent
Amico

(10) Patent No.: US 12,656,079 B2
(45) Date of Patent: Jun. 16, 2026

(54) QUICK DISCONNECT SLING MOUNT FOR A FIREARM

(71) Applicant: Sig Sauer, Inc., Newington, NH (US)

(72) Inventor: Zachary A. Amico, Danville, NH (US)

(73) Assignee: Sig Sauer, Inc., Newington, NH (US)

( * ) Notice: Subject to any disclaimer, the term of this patent is extended or adjusted under 35 U.S.C. 154(b) by 140 days.

(21) Appl. No.: 18/501,099

(22) Filed: Nov. 3, 2023

(65) Prior Publication Data

US 2024/0151492 A1 May 9, 2024

Related U.S. Application Data

(60) Provisional application No. 63/382,381, filed on Nov. 4, 2022.

(51) Int. Cl.
*F41C 23/02* (2006.01)

(52) U.S. Cl.
CPC ..... *F41C 23/02* (2013.01)

(58) Field of Classification Search
CPC ..... F41C 23/02; F41C 33/006; Y10T 24/12; Y10T 24/4764; B66C 1/66; Y10S 24/53
USPC ..... 42/85; 224/150
See application file for complete search history.

(56) References Cited

U.S. PATENT DOCUMENTS 2,078,010 A * 4/1937 Meepos ..... F41C 23/02 24/265 CD
2,723,430 A * 11/1955 Paillard ..... A45C 11/38 81/58.3
3,061,965 A * 11/1962 Lewis ..... F41C 23/02 42/85
3,066,375 A * 12/1962 Knowles ..... F41C 23/02 24/639
3,226,872 A * 1/1966 Pachmayr ..... F41C 23/02 42/85
4,079,983 A * 3/1978 Van Mastrigt ..... B66C 1/66 52/125.5
4,315,651 A * 2/1982 Endicott, Jr. ..... B63C 7/16 294/93
5,692,654 A * 12/1997 Bell ..... F41C 23/02 24/2.5
2020/0240743 A1* 7/2020 Cahill ..... F41C 23/14
2021/0215452 A1* 7/2021 Robinson ..... F41C 23/02

* cited by examiner

*Primary Examiner* — Jack W Lavinder

(74) *Attorney, Agent, or Firm* — Secant IP, PLLC

(57) ABSTRACT

A quick disconnect assembly for a sling mount includes a cup having a top portion and a shaft portion connected to the top portion, the cup defining a non-circular through-opening and a recess that extends axially part way into the shaft portion. A post includes a post body extending axially between a first end portion and a second end, the first end portion having one or more protrusions. The post is configured to pass through the through-opening in the cup when the post is in an unlocked position with the protrusion(s) aligned with the through-opening. Rotating the post to a locked position aligns the protrusion(s) with the recess, which can define a plus shape with the through opening. A mounting body on the second end of the post defines or can include an attachment point. A spring is on the post between the mounting body and the cup.

17 Claims, 10 Drawing Sheets

QUICK DISCONNECT SLING MOUNT FOR A FIREARM

RELATED APPLICATIONS

This application claims the benefit under 35 U.S.C. § 119(e) of U.S. Provisional Patent Application No. 63/382,381 titled QUICK DISCONNECT SLING MOUNT FOR A FIREARM and filed on Nov. 4, 2022, the contents of which are incorporated herein by reference in its entirety.

TECHNICAL FIELD

The present disclosure relates generally to accessories for firearms, and more particularly to a quick disconnect sling mount for a rifle or long gun.

BACKGROUND

A sling can be attached to a rifle or other long gun to assist the shooter in carrying the gun. In some circumstances, the sling can also be useful to stabilize the gun during shooting. The sling can be attached to the gun in a variety of ways. Traditionally, a two-point sling attaches to the front and rear of the gun and allows the user to carry the gun over the back with the sling draped across the torso or with the sling over one shoulder. A one-point sling attaches to the gun at a single location. The one-point sling allows the shooter to easily transition the gun from one shoulder to the other, providing the ability to switch to weak-side shooting as needed.

SUMMARY

The present disclosure is directed to a quick-disconnect ("QD") sling mount for use with rifles and long guns. The QD attachment includes a cup with a through-opening corresponding to the end portion of a post. For example, the first end portion of the post defines a T-shape and the through-opening has the shape of a central circular region intersecting a slot. The opposite second end portion of the post attaches to an attachment point, such as a D-ring. The post can be installed in the through-opening, then rotated and allowed to seat in a recess in the cup. A spring on the post body retains the post in the locked position and similarly biases the post towards removal when the first end portion is aligned with the through-opening.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
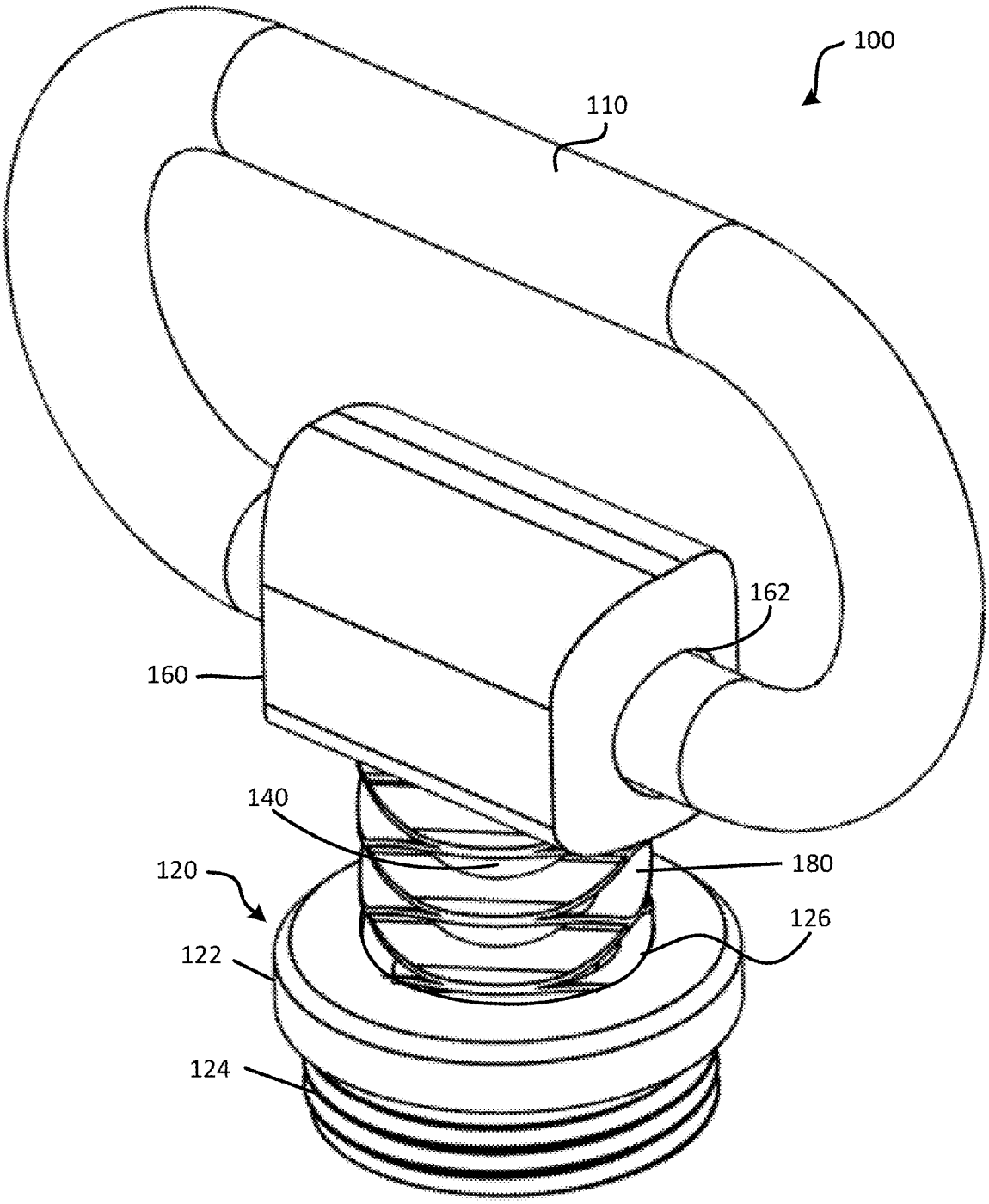
FIG. 1 illustrates a perspective view of a quick-disconnect (QD) assembly, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a quick-disconnect ("QD") sling mount for a rifle or other long gun. In accordance with one example embodiment, the sling mount includes a cup portion that can be attached to the gun, such as by threaded engagement with a receptacle in the stock or handguard. A post portion is configured to be received in the cup and includes an end portion with a lateral protrusion, such as a T-shape. An underside of the cup defines a recess, such as a plus or cloverleaf shape, that accepts the T-shaped end of the post in either a locked position or an unlocked position. Part of the recess (e.g., two opposite lobes of the plus shape) extend all the way through the post as part of the through-opening. The post can be installed in or removed from the cup when the T-shaped post is aligned with the open portion of the recess. After inserting the T-shape through the through-opening, the T-shape can be rotated 90° and then seated in the other two lobes of the plus shape (e.g., a slot-shaped recess in the bottom of the cup), which are recesses rather than through openings. A spring, such as a wave spring, is installed on the post between a top surface of the cup and a mount body at the opposite end of the post. The spring maintains the T-shaped end portion in the recesses and biases the T-shaped end portion against the cup when in the locked position.

From the locked position, the user can press the post axially into the cup against spring pressure, turn the post to the unlocked position where the T-shape aligns with the through-opening, and then release pressure on the spring to allow the T-shaped post to pass through the cup. To secure the attachment point, the post can be installed through the through-opening of the cup, then rotated to the locked position and the T-shaped end portion allowed to seat in the corresponding recess in the cup. The mount body can define a through-opening for installation of a D-ring or other loop. Alternately, paracord or the like can be passed through the mount body. Numerous options and embodiments will be apparent from the following discussion.

Overview

A rifle may include strap hooks or swivel studs for use with a sling. The strap hooks or swivel studs can be secured to the fore end of the stock adjacent the barrel and near the butt end of the stock. In the case of a wooden stock, the strap hooks or swivel studs can be screwed into the stock with a wood screw. More recently, tactical and squad rifles include an adjustable stock made of polymers and a handguard made of metal. In such cases, the stock itself may define strap openings to accommodate a sling. For example, the stock defines one or more slotted strap openings through which the sling strap can be threaded. Alternately, the stock can define a circular cup to receive a quick-disconnect sling mount. The handguard can similarly be equipped with a mounting cup for the spring-loaded latching mechanism. For example, the cup portion has an internal recess, and the mount includes a post with a spring-loaded ball latching mechanism. The user can depress a button on the post to release the latching mechanism for installing the post in or removing the post from the cup. The mount may include a D-ring or the like for attaching a sling.

The spring-loaded ball latching mechanism has been relatively effective for quickly attaching a sling to a rifle. However, in some circumstances, the latch mechanism fails unexpectedly, releasing the post and allowing the gun to fall if the user does not have a grip on it. For example, the internal groove can be overly shallow, or may wear over time, which reduces the holding power of the latch mechanism. Also, some designs for QD mounts have a button that is raised above the surrounding surface. Bumping the button while carrying the gun or when setting the gun down on the mount can release the sling inadvertently. Unfortunately, making the spring-loaded ball latch mechanism sufficiently robust is a manufacturing change that increases cost and weight. Thus, despite the convenience provided by existing QD sling mounts, non-trivial challenges remain.

The present disclosure addresses these challenges and others by providing a quick-disconnect ("QD") sling mount that does not rely on a spring-loaded ball latch.

EXAMPLE EMBODIMENTS

Figure 2:
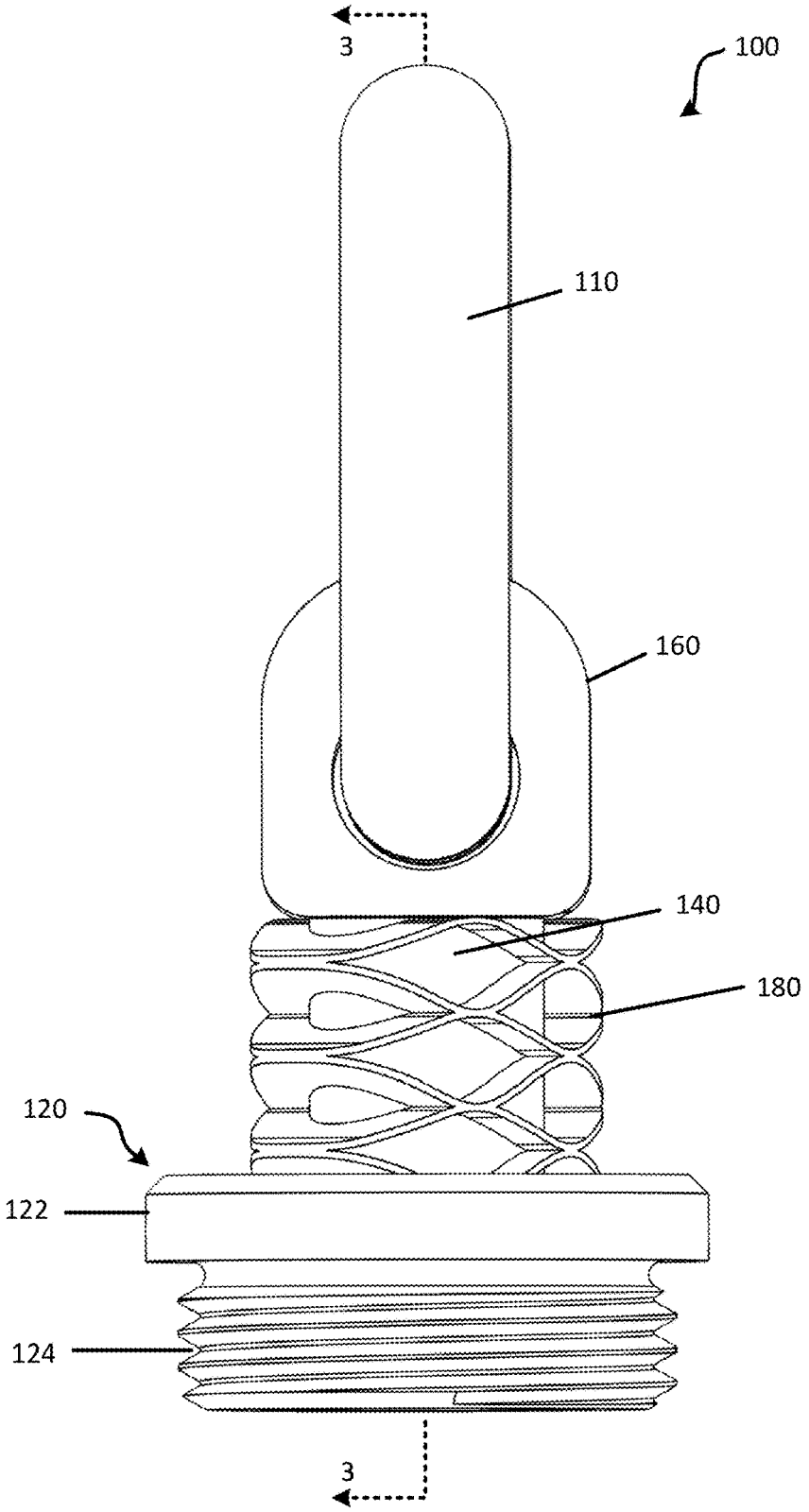
FIG. 2 illustrates a side view of the QD assembly of FIG. 1.

FIGS. 1 and 2 illustrate a perspective view and a side view, respectively, of a quick-disconnect ("QD") assembly 100 for a sling attachment point 110, in accordance with an embodiment of the present disclosure. In this example embodiment, the assembly 100 includes a cup 120 with a top portion 122 and a threaded shaft 124 connected to and extending axially from the top portion 122. The cup 120 defines a through-opening 126 that is sized and shaped to receive a first end of the post 140.

The top portion 122 and shaft 124 are shown as both having a cylindrical shape, although this is not required in all embodiments. In other embodiments, for example, the top portion 122 has a rectangular, hexagonal, or other shape. In some embodiments, the shaft 124 can have other geometries that can be received in and threadably engage a threaded cylindrical bore or equivalent. In yet other embodiments, the shaft 124 need not include threads and can be received in an opening in a stock or gun furniture and then secured using a pin, lock ring, weld, or other suitable method. In some such embodiments, the shaft 124 can have a non-circular cross-sectional shape.

A mount body 160 can be attached to a second end of the post 140. For example, the mount body 160 defines a through-opening 162 that defines or receives the attachment point 110, which can be, for example, a D-ring, a loop, a hook, or a length of paracord. Alternately, the mount body 160 and post 140 can be made as a single structure.

A spring 180 is installed in a resting or slightly compressed state on the post 140 between the top portion 122 of the cup 120 and the mount body 160. In this example, the spring 180 is a wave spring, although a coil spring can be used in some embodiments. The spring 180 functions to bias the first end of the post 140 against the inside face of the cup when the post 140 is rotated to the locked position, which is discussed in more detail below.

Figure 3A:
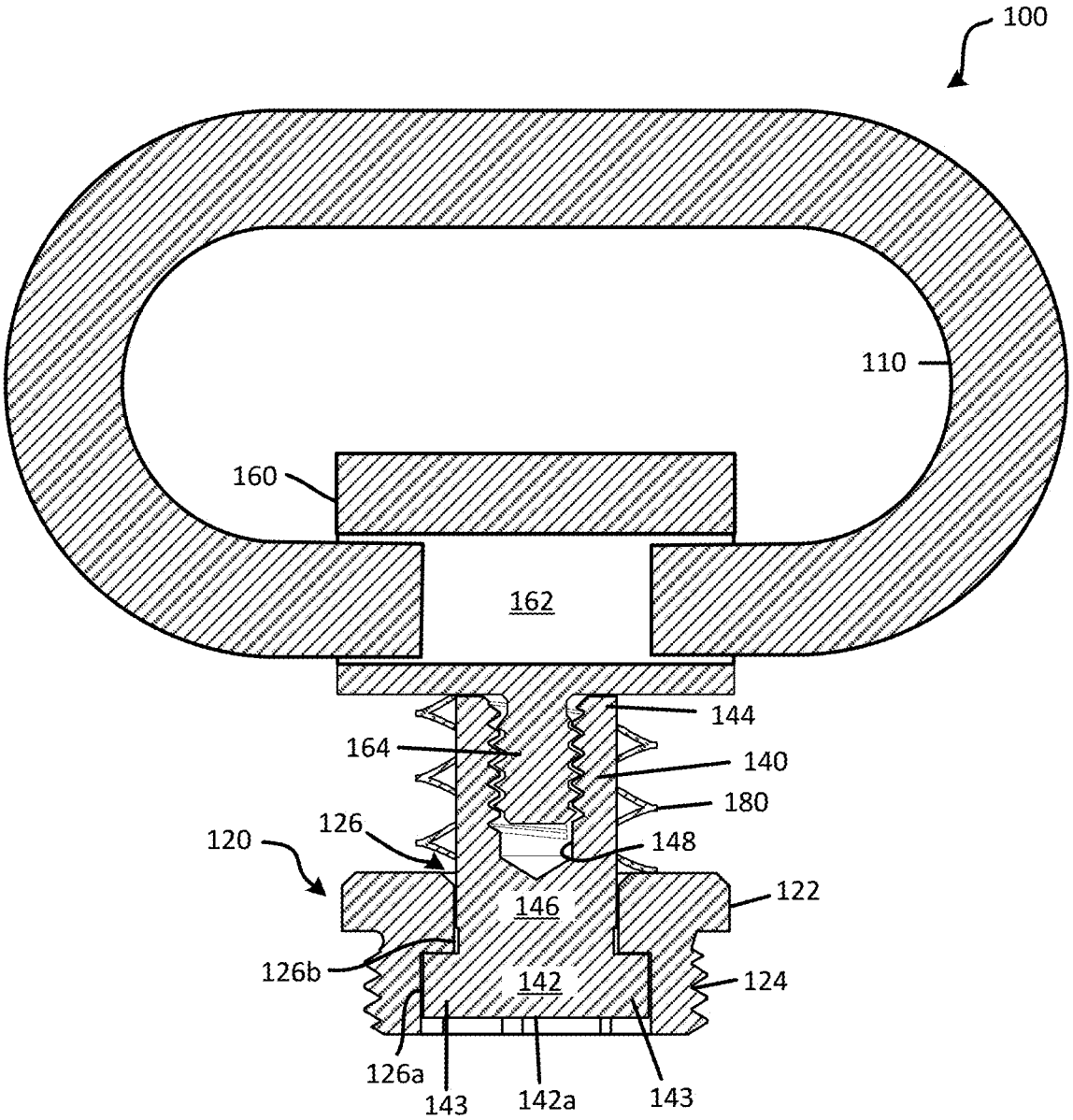
FIG. 3A illustrates a cross-sectional view of the QD assembly as viewed along line 3-3 of FIG. 2, in accordance with an embodiment of the present disclosure.
Figure 3B:
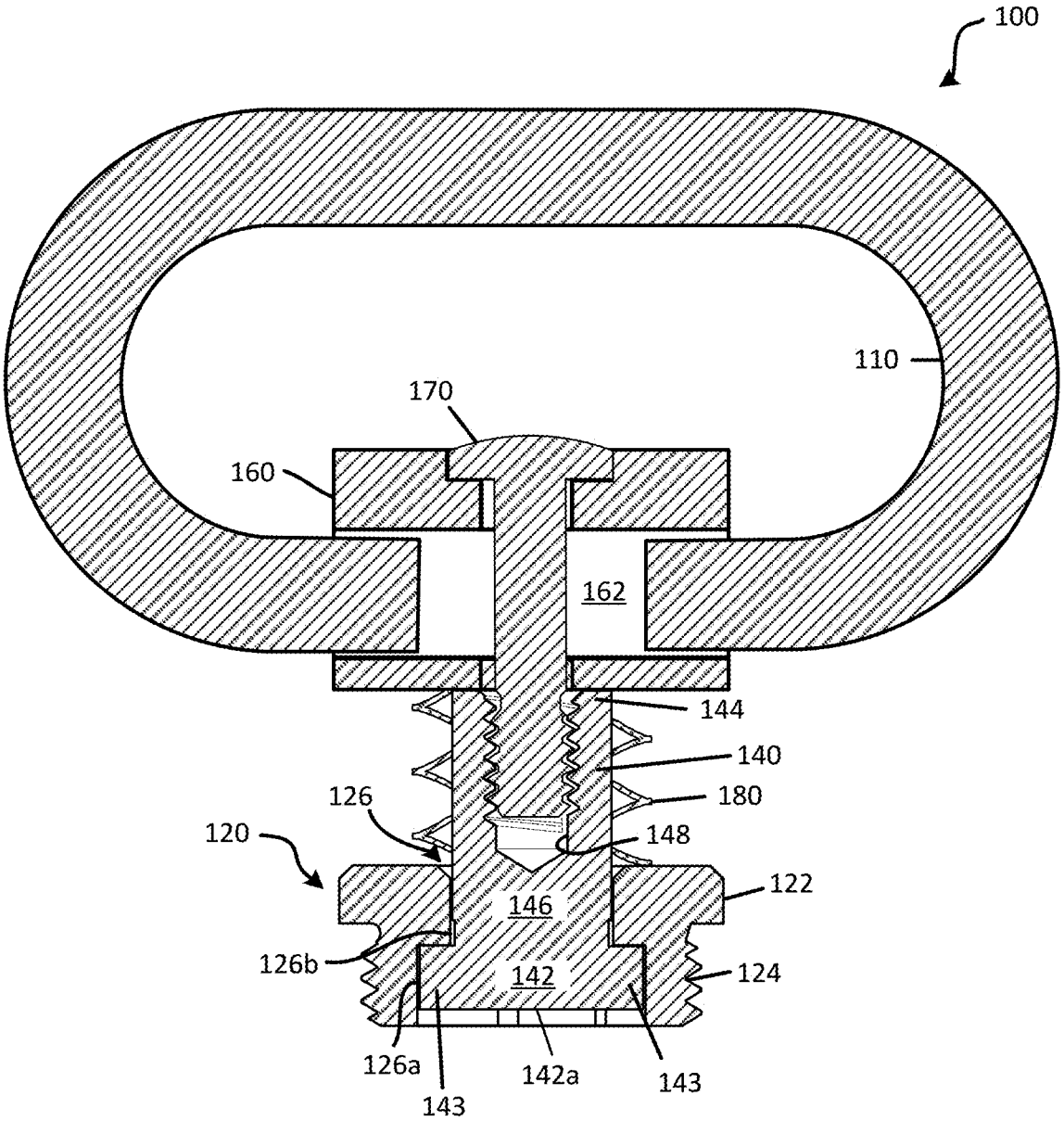
FIG. 3B illustrates a cross-sectional view of a QD assembly in which a fastener is used to connect the mount body to the post, in accordance with an embodiment of the present disclosure.

FIG. 3A illustrates a cross-sectional view of QD assembly 100 in a locked position as viewed along line 3-3 of FIG. 2, in accordance with an embodiment of the present disclosure. FIG. 3B illustrates a cross-sectional view of the QD assembly 100 with a fastener 170 used to secure the mount body 160 to the post 140. In these examples, the attachment point 110 is an open D-ring with ends of the D-ring received in the through-opening 162 of the mount body 160. In the example of FIG. 3A, the mount body 160 attaches to the post 140 with a threaded rod 164 on the mount body 160 and that threadably engages a threaded bore 148 in the post 140. As illustrated, the threaded rod 164 is part of the mount body 160 and extends into the bore 148. In the example of FIG. 3B, a separate fastener 170 can be used in place of the threaded rod 164, such as a fastener 170 extending through the mount body 160 and into the threaded bore 148. Optionally, a lock washer (not shown) or thread locking compound can be used as needed to prevent loosening of the threaded engagement.

The first end portion 142 of the post 140 has at least one protrusion 143 extending laterally outward beyond the cylindrical portion 146. For example, the post 140 includes a pair of lateral protrusions 143 defining a T-shape sized to be received in a first region of greater size 126*a* and a second region 126*b* of greater size. The first region of greater size 126*a* is a recess that extends axially part way into the post 140 from the first end. Since this second region of greater size 126*b* does not extend through the top of the cup 120, the protrusion(s) 143 on the first end portion 142 abuts the inside of the cup 120 and therefore the post 140 is prevented from passing through the through-opening 126. Accordingly, the post 140 is in the locked position and ready for use with a sling or the like when the T-shaped first end portion 142 is seated in the second region of greater size 126*b*. The spring 180 is compressed between the cup 120 and mount body 160 to bias the first end portion 142 of the post 140 against the inside of the cup 120.

Figure 4:
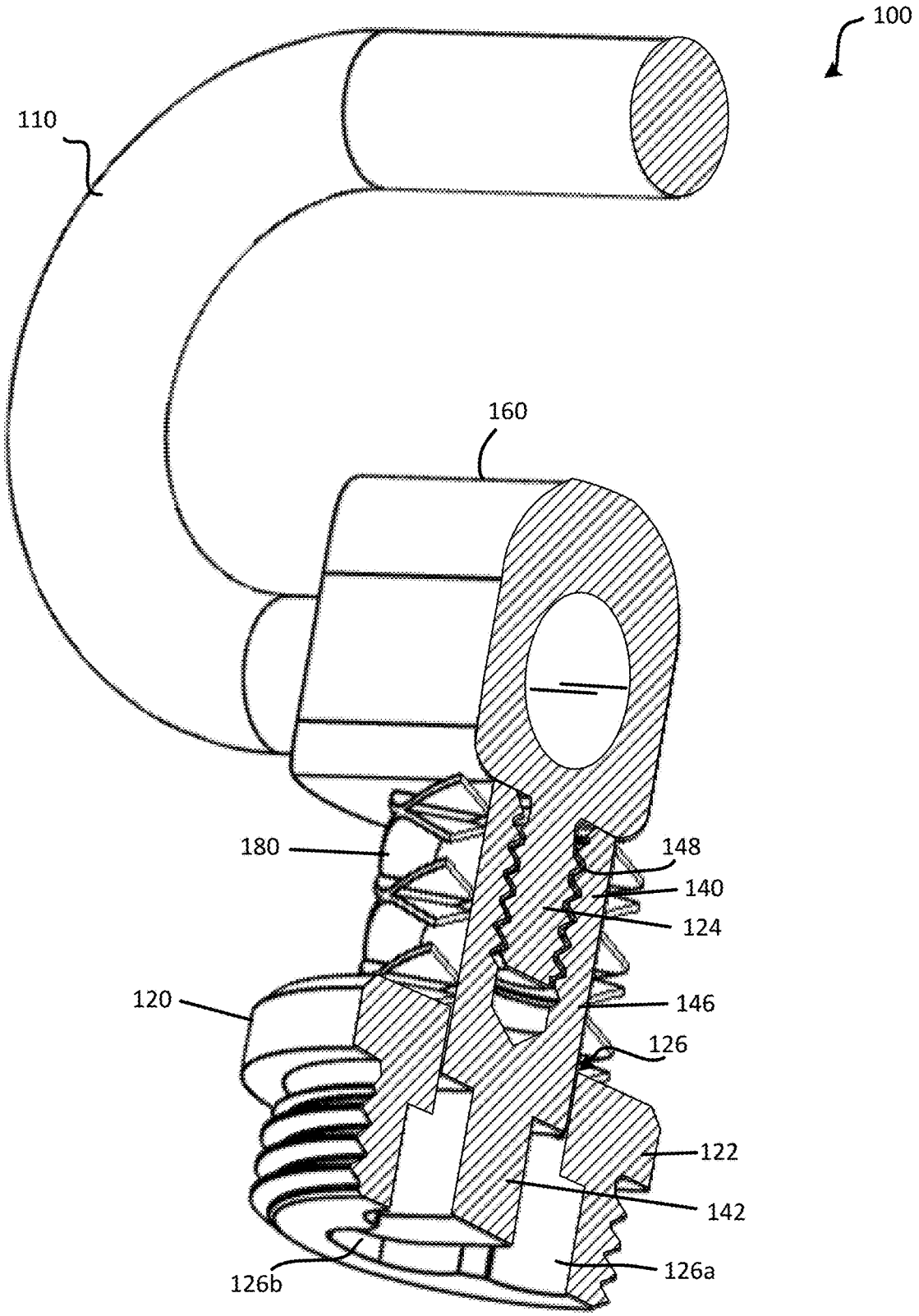
FIG. 4 illustrates a perspective, cross-sectional view of a QD attachment with the post in an unlocked position, in accordance with an embodiment of the present disclosure.

FIG. 4 is a perspective, cross-sectional view of a QD assembly 100 in an unlocked position, in accordance with an embodiment of the present disclosure. In this example, the post 140 has been rotated 90 degrees in the cup 120 compared to the locked position shown in FIG. 3. The spring 180 is omitted in this example to more clearly show the relationship between the post 140 and the cup 120. As noted above, the mount body 160 threadably engages the threaded bore 148 that extends into the post 140. The protrusions 143 on the first end portion 142 of the post 140 are aligned with the second region of greater size 126*b* that is part of the through-opening 126 that continues through the top portion 122 of the cup 120. In this unlocked position, the through-opening 126, which includes the second region of greater size 126*b*, permits insertion and removal of the post 140.

Figure 5A:
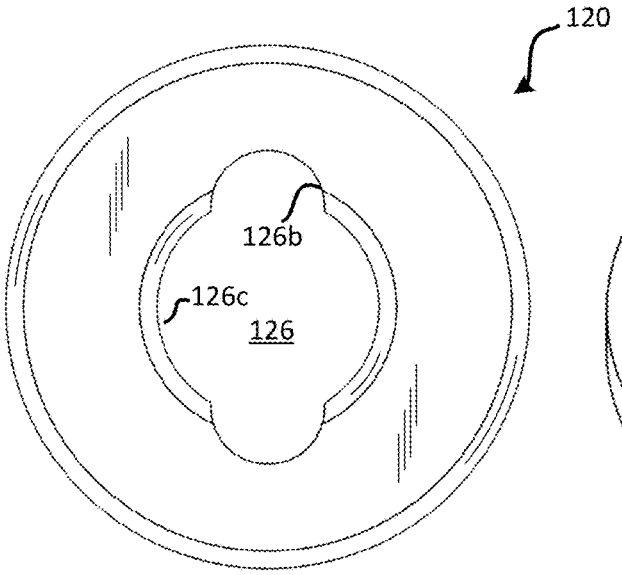
FIGS. 5A-5C illustrate top, bottom perspective, and side views, respectively, of a cup, in accordance with an embodiment of the present disclosure.
Figure 5B:
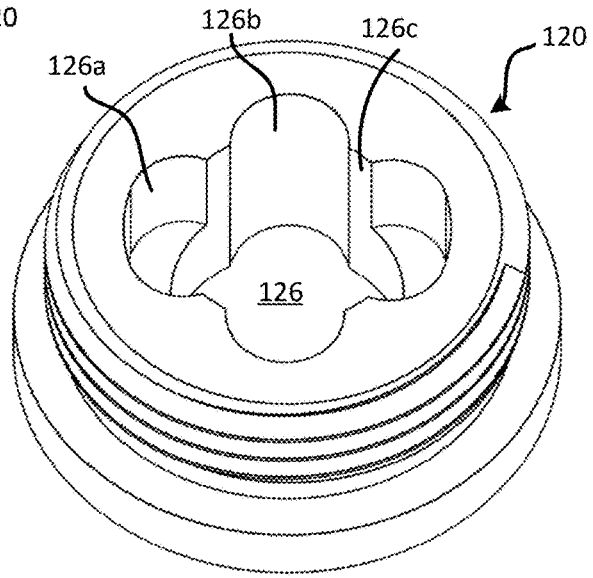
Figure 5C:
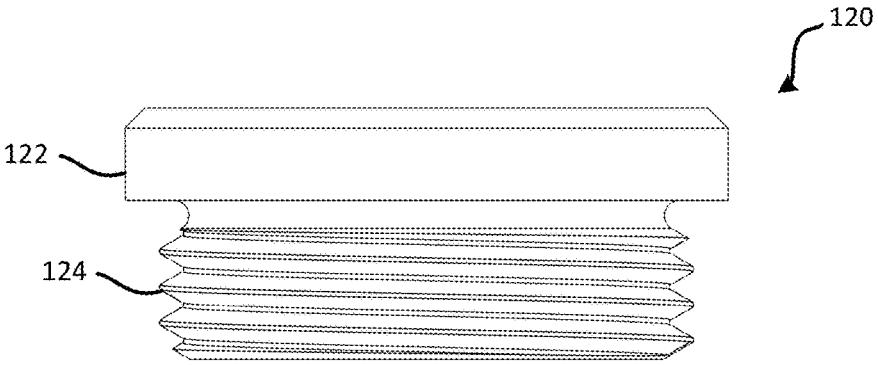

FIGS. 5A, 5B, and 5C illustrate a top view, a bottom perspective view, and a side view, respectively, of a cup 120, in accordance with an embodiment of the present disclosure. The cup 120 has an overall circular cross-sectional shape with a centrally located through-opening 126. The top portion 122 has a greater diameter than the threaded shaft 124, enabling the top portion 122 to function as a stop when the cup 120 is threaded into an opening. In the top view of FIG. 5A, the through-opening 126 has a compound shape with a central circular region 126*c* that intersects the second region of greater size 126*b*, which has an elongated or slot shape. In the bottom perspective view of FIG. 5B, the first region of greater size 126*a* and the recessed second region of greater size 126*b* are visible. These regions intersect to define a cross or plus shape, a portion of which (the second region of greater size 126*b*) extends through the cup 120 along with the central circular region 126*c*. The first region of greater size 126*a* is machined or otherwise formed to extend axially only part way into the cup 120. In one example, the first region of greater size 126*a* has an axial depth approximately equal to the axial dimension of the threaded shaft 124.

The plus shape defined by the regions of greater size 126*a*, 126*b* prevents the first end portion 142 from rotating when it is received in one of these regions. As such, the post 140 can be pushed axially into the cup 120 so that the T-shaped first end portion 142 clears the shaft 124 of the cup 120. After doing so, the post 140 can be rotated to align the first end portion 142 with either the first region of greater size 126*a* for a locking condition or with the second region of greater size 126*b* for removal. With the first end portion 142 of the post 140 aligned to seat in one of the regions of greater size 126*a*, 126*b*, the spring 180 biases the post 140 towards a locked condition or towards removal through the through-opening 126, respectively.

Figure 6A:
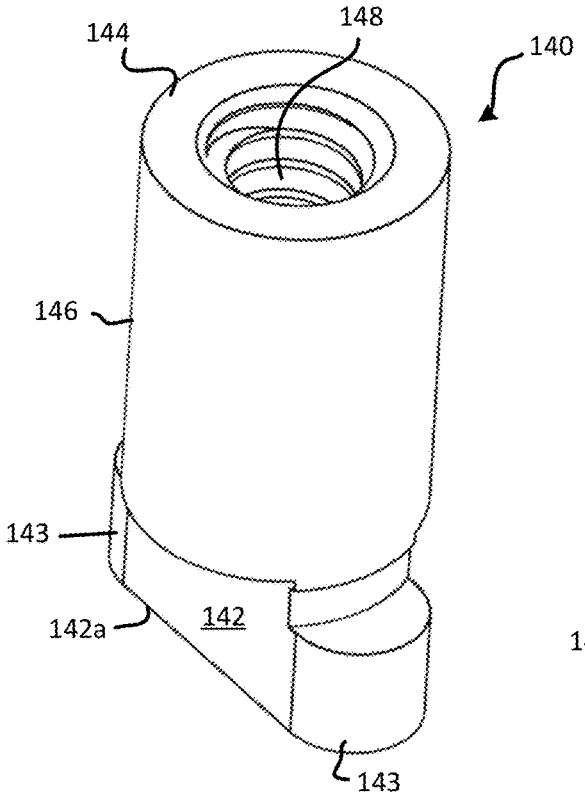
FIGS. 6A-6C illustrate a perspective view, a side view, and a top view, respectively, of a post, in accordance with an embodiment of the present disclosure.
Figure 6B:
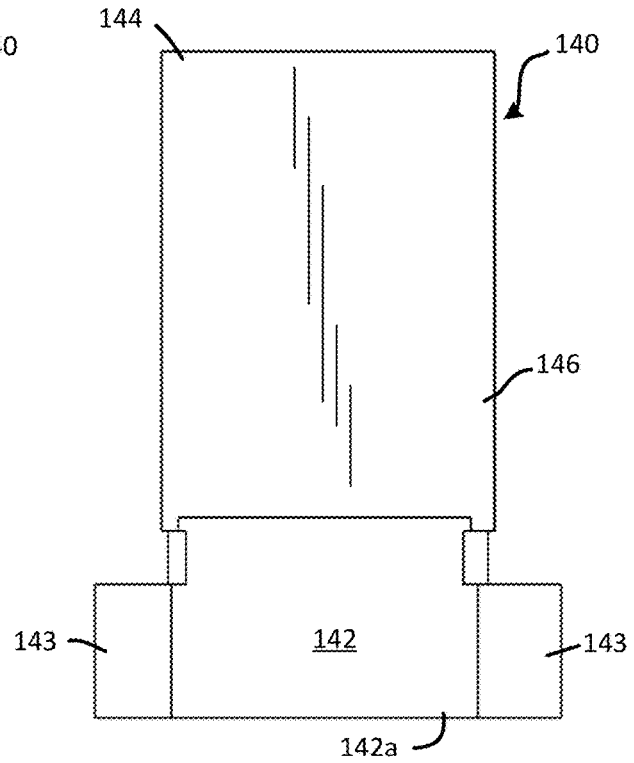
Figure 6C:
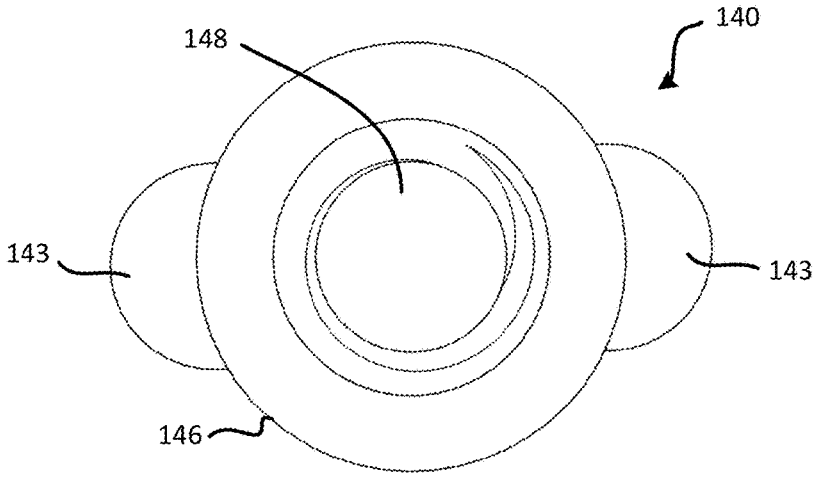

FIGS. 6A, 6B, and 6C illustrate a top perspective view, a side view, and a top view, respectively, of a post 140, in accordance with an embodiment of the present disclosure. As noted above, the post 140 extends axially from a first end 142*a* to a second end 144 and includes a first end portion 142 that is connected to a post body or cylindrical portion 146. The first end portion 142 includes one or more protrusions 143 extending laterally beyond the cylindrical portion 146. In this example, the first end portion has two protrusions oriented 180° from one another to define a T-shape at the first end portion 142. The threaded bore 148 extends axially into the cylindrical portion 146 through the second end 144. In some embodiments, the cylindrical portion 146 is sized for a clearance fit through the central circular region 126*c* of the through-opening 126*a* with a clearance of not more than 0.5 mm. The clearance between the central circular region 126*c* and the cylindrical portion 146 can be tailored as desired.

Figure 7A:
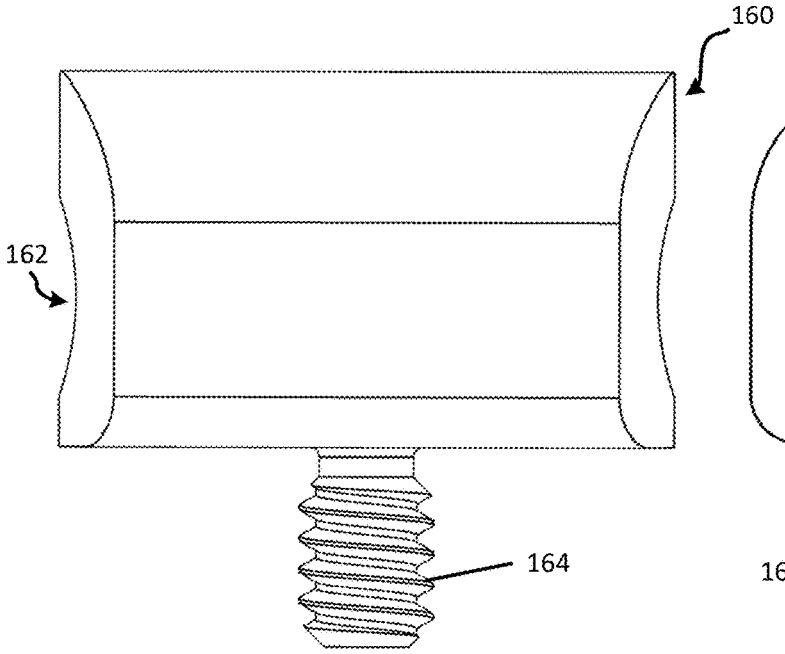
FIGS. 7A-7C illustrate front, side, and bottom views, respectively, of a mount body, in accordance with an embodiment of the present disclosure.
Figure 7B:
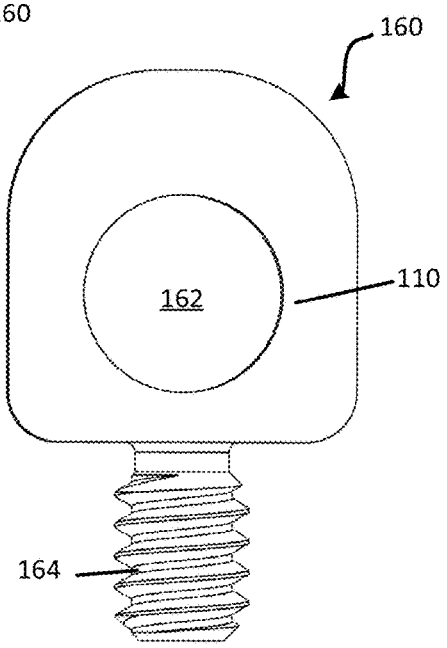
Figure 7C:
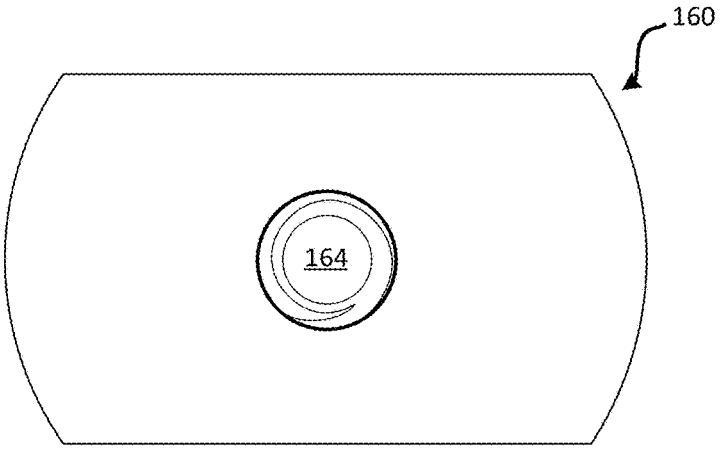

FIGS. 7A, 7B, and 7C illustrate a front view, a side view, and a bottom view, respectively, of a mount body 160, in accordance with an embodiment of the present disclosure. The mount body 160 includes a threaded rod 164 that is configured and sized to threadably engage the threaded bore 148 in the post 140. As seen in the side view of FIG. 7B, the mount body 160 defines a through-opening 162. The mount body 160 can define or include the attachment point 110. In examples discussed above, the attachment point 110 attaches to the mount body 160 via the through-opening 162. In other embodiments, the through-opening 162 can function as the attachment point 110, such as for use with paracord or a connector, for example. Numerous variations and embodiments will be apparent in light of the present disclosure.

Figure 8:
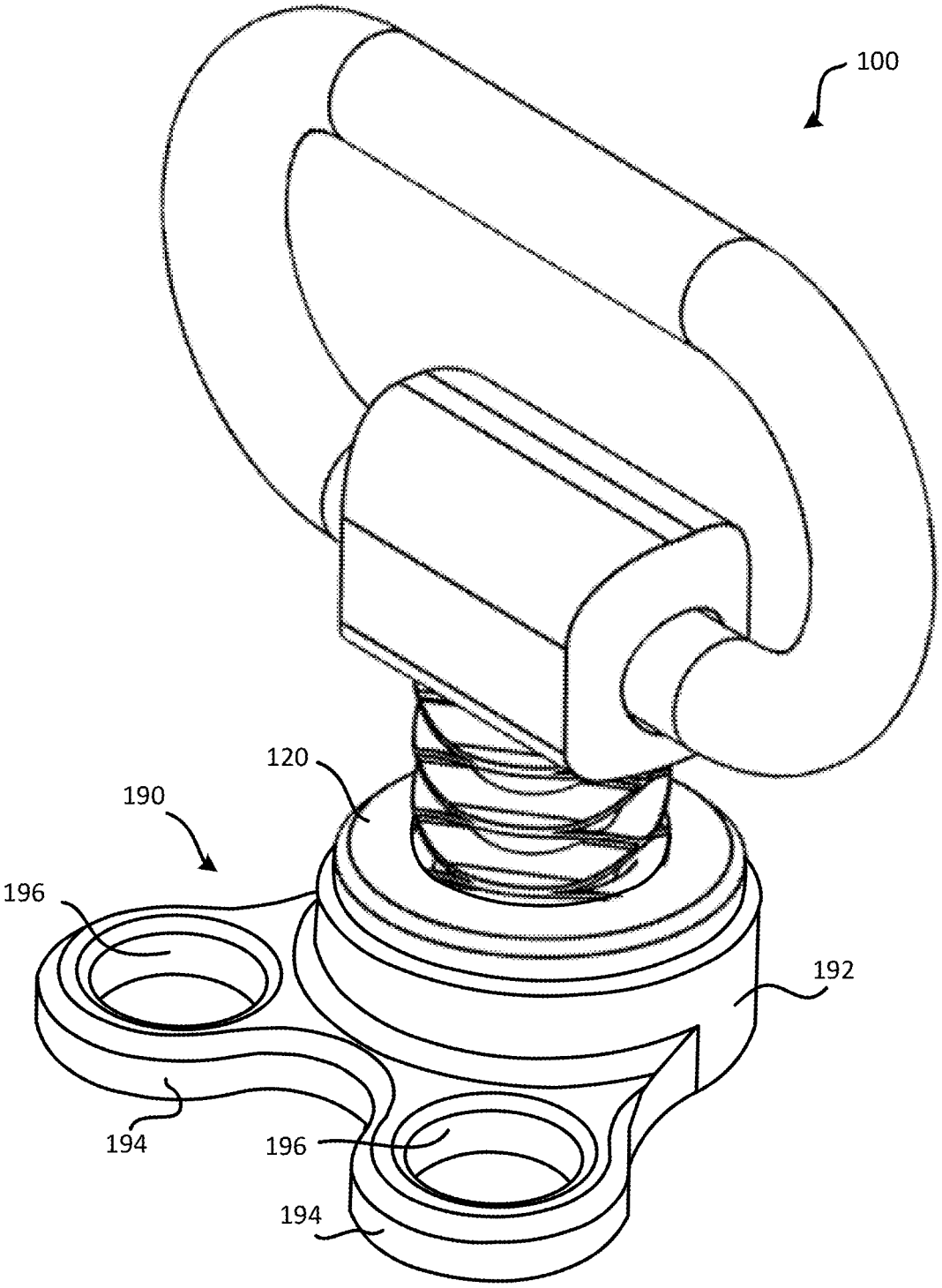
FIG. 8 illustrates a QD assembly that includes a cup receptacle, in accordance with an embodiment of the present disclosure.

FIG. 8 illustrates a perspective view of a QD assembly 100 that includes a cup receptacle 190, in accordance with an embodiment of the present disclosure. The cup receptacle 190 can be used with the cup 120 and other components of the QD assembly 100 discussed above. The cup receptacle 190 is configured to be attached to a firearm, such as to a handguard or stock, and to function as a location to attach the QD assembly 100 to the firearm. The cup receptacle 190 defines a receptacle body 192 with a threaded opening (not visible) that is sized and configured to receive the threaded shaft 124 of the cup 120. The receptacle body 192 is further configured for secure attachment to the firearm, whether by use of fasteners, threaded engagement, a weld, the receptacle body 192 and top portion 122 of the cup 120 engaging opposite faces of a structure when assembled, or other suitable method. In this example, the cup receptacle 190 defines two lobes 194 each of which defines a fastener opening 196. A fastener can be received through each lobe 194 to secure the cup receptacle 190 to a firearm receiver, a handguard, or other structure.

Figure 9:
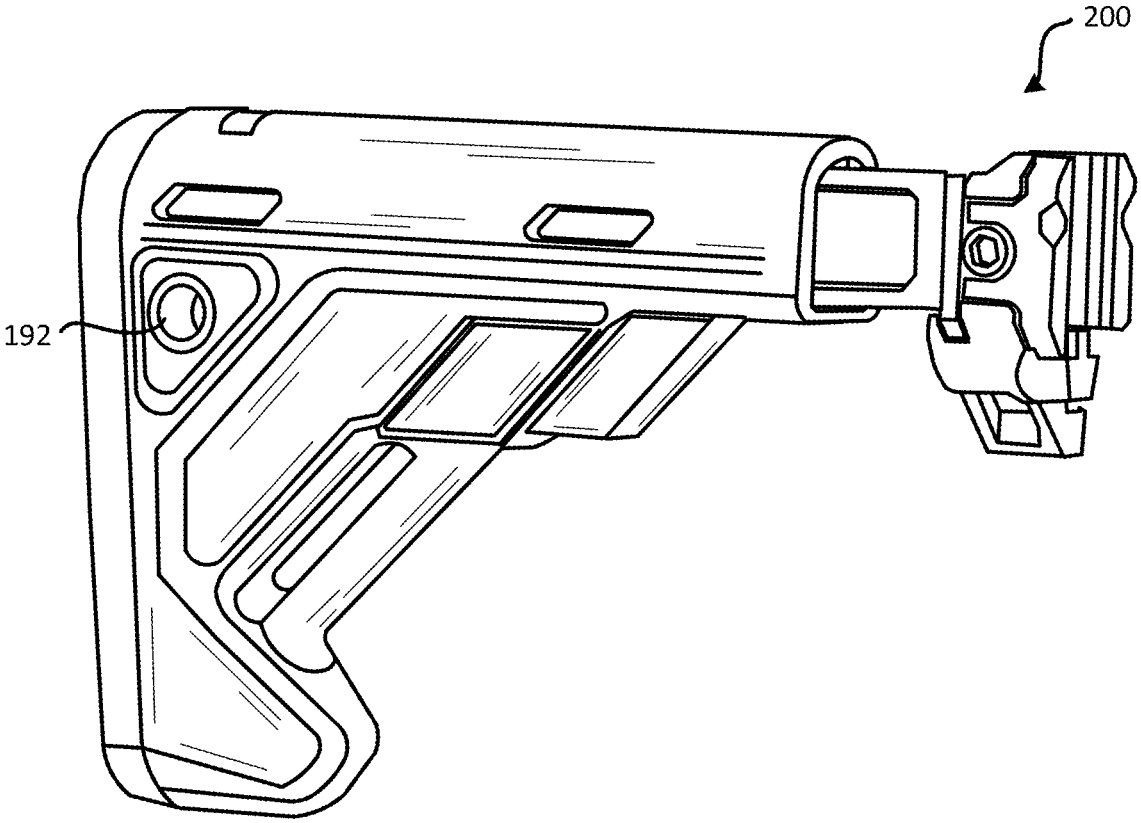
FIG. 9 illustrates an adjustable stock that includes a cup receptacle, in accordance with an embodiment of the present disclosure.

FIG. 9 illustrates a side view of an adjustable rifle stock 200 with a receptacle body 192 secured into the stock and threaded to receive a cup 120, as discussed above.

In use, the QD assembly 100 as variously disclosed herein can be attached to a rifle or other long gun and provide quick, toolless removal and attachment of a sling attachment point 110, while also providing secure attachment to the gun when installed and locked. The cup 120 can be installed in a threaded opening in a stock, handguard, or other part of a gun. Alternately, the cup 120 can be formed as part of a stock or handguard, for example. When the QD assembly 100 includes the cup receptacle 190, additional attachment options are available, such as attachment to the firearm receiver.

FURTHER EXAMPLE EMBODIMENTS

The following examples pertain to further embodiments, from which numerous permutations and configurations will be apparent.

Example 1 is a quick disconnect assembly for a sling. The assembly includes a cup having a top portion and a shaft connected to the top portion, the cup defining a non-circular through-opening and a recess extending axially part way into the shaft. A post includes a post body extending axially between a first end portion and a second end, the first end portion having one or more protrusion, where the post is configured to pass through the through-opening in the cup when the post is in an unlocked position and the protrusion is configured to be received in the recess when the post is in a locked position. A mounting body on a second end of the post defines an attachment point for a sling. A spring is between the mounting body and the cup.

Example 2 includes the assembly of Example 1, where the through-opening has a cross-sectional shape of a central circular region intersecting a slot, and the recess has a slot shape oriented transversely to the slot of the through-opening.

Example 3 includes the assembly of Example 1 or 2, where the attachment point comprises a D-ring attached to the mounting body.

Example 4 includes the assembly of Example 1 or 2, where the attachment point comprises an opening through the mounting body.

Example 5 includes the assembly of any one of Examples 1-4, where the spring is configured as a wave spring installed on the post body.

Example 6 includes the assembly of any one of Examples 1-5, where the one or more protrusions on first end portion of the post defines a T-shape with the post body.

Example 7 includes the assembly of any one of Examples 1-6, where the post defines a threaded bore extending into the second end and the mounting body includes a threaded rod, and where the mounting body can be secured to the post by threaded engagement between the threaded rod and the threaded bore.

Example 8 includes the assembly of any one of Examples 1-6, where the post defines a threaded bore extending into the second end, where the mounting body defines a fastener opening extending axially therethrough, and where the assembly further comprises a fastener sized and configured to extend through the fastener opening in the mounting body and to engage the threaded bore to secure the mounting body to the post.

Example 9 includes the assembly of any one of Examples 1-8, where the mounting body and the post comprise a single monolithic structure.

Example 10 includes the assembly of any one of Examples 1-9, where the non-circular through-opening and the recess define a plus shape as viewed looking axially at the shaft of the cup.

Example 11 includes the assembly of any one of Examples 1-10, where the shaft is configured to be retained in a receptacle with a pin or locking ring.

Example 12 includes the assembly of any one of Examples 1-10, where the shaft is threaded, and the assembly further comprises a cup receptacle having a receptacle body that defines a threaded opening configured to receive the threaded shaft of the cup.

Example 13 includes the assembly of Example 12, where the cup receptacle further defines one or more lobes connected to the receptacle body, the one or more lobes defining a fastener opening.

Example 14 includes the assembly of Example 12, where the cup receptacle is part of an adjustable stock for a long gun.

Example 15 includes the assembly of Example 12, where the cup receptacle is part of a hand guard for a long gun.

Example 16 includes the assembly of any one of Examples 1-15, where the assembly is provided in a disassembled form.

Example 17 includes the assembly of any one of Examples 1-16, where the top portion and the shaft of the cup have a circular cross-sectional shape.

Example 18 includes the assembly of any one of Examples 1-15, where the top portion of the cup has a non-circular cross-sectional shape.

Example 19 is a quick disconnect assembly for a sling mount, the assembly comprising a cup having a top portion and a shaft connected to the top portion, the cup defining a through-opening axially through the top portion and the shaft, the through-opening having a cross-sectional shape of a central circular region intersecting a slot, the cup further defining a recess extending axially part way into the shaft, the recess having a slot shape oriented transversely to the slot of the through-opening. A post including a post body extends axially between a first end portion and a second end, the first end portion having a protrusion extending laterally outward, where the post is configured to pass through the through-opening in the cup when the post is in an unlocked position and the protrusion is configured to be received in the recess when the post is in a locked position. A mounting body on the second end of the post defines an attachment point for a sling. A spring is between the mounting body and the cup.

Example 20 includes the assembly of Example 19, where the attachment point comprises a D-ring pivotably attached to the mounting body.

Example 21 includes the assembly of Example 19, where the attachment point comprises an opening through the mounting body.

Example 22 includes the assembly of any one of Examples 19-21, where the spring is configured as a wave spring installed on the post body.

Example 23 includes the assembly of any one of Examples 19-22, where the first end portion of the post defines a T-shape.

Example 24 includes the assembly of any one of Examples 15-19, where the mounting body and the post comprise a single monolithic structure.

Example 25 includes the assembly of any one of Examples 19-23, where the post defines a threaded bore extending into the second end and the mounting body includes a threaded rod, and where the mounting body can be secured to the post by threaded engagement between the threaded rod and the threaded bore.

Example 26 includes the assembly of any one of Examples 19-23 and 25, where the post defines a threaded bore extending into the second end, where the mounting body defines a fastener opening extending axially therethrough, and where the assembly further comprises a fastener sized and configured to extend through the fastener opening in the mounting body and to engage the threaded bore to secure the mounting body to the post.

Example 27 includes the assembly of any one of Examples 19-27, where a combination of the slot of the through-opening and the recess define a plus shape as viewed looking axially at the shaft of the cup.

Example 28 includes the assembly of any one of Examples 19-27, where the shaft is threaded, and the assembly further comprises a cup receptacle having a receptacle body defining a threaded opening configured to receive the threaded shaft of the cup.

Example 29 includes the assembly of Example 28, where the cup receptacle further defines one or more lobes connected to the receptacle body, the one or more lobes defining a fastener opening.

Example 30 includes the assembly of Example 28, where the cup receptacle is part of an adjustable stock for a long gun.

Example 31 includes the assembly of Example 28, where the cup receptacle is part of a hand guard for a long gun.

Example 32 includes the assembly of any one of Examples 19-31, where the assembly is provided in a disassembled form.

Example 33 includes the assembly of any one of Examples 19-32, where the top portion of the cup and the shaft of the cup have a circular cross-sectional shape.

Example 34 includes the assembly of any one of Examples 19-32, where the top portion of the cup has a non-circular cross-sectional shape.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A quick disconnect assembly for a sling, the assembly comprising:

a cup having first end portion defining a through opening and a cylindrical body portion connected to and extending axially from the first end portion to an open second end, the first end portion and the cylindrical body portion defining a non-circular through-opening, and the cylindrical body portion defining a recess extending axially part way into the cylindrical body portion from the open second end, wherein the cylindrical body portion is threaded;

a post extending axially between a first end portion and a second end, the first end portion of the post having one or more protrusions, wherein the first end portion of the post is configured to pass through the non-circular through-opening in the cup when the post is in a first rotational position and wherein the one or more protrusions are configured to be received in the recess when the post is in a second rotational position;

an attachment point on the second end of the post;

a spring on the post between the attachment point and the cup; and a receptacle having a receptacle body defining a threaded opening configured to threadingly engage the cylindrical body portion of the cup, wherein the receptacle has one or more lobes connected to the receptacle body, and wherein each of the one or more lobes defines a fastener opening.

2. The quick disconnect assembly of claim 1, wherein the through-opening has a cross-sectional shape of a circular region intersecting an elongated slot, and the recess has a slot shape oriented crosswise to the elongated slot of the through-opening, wherein in combination the non-circular through-opening and the recess define a plus shape as viewed looking axially into the cylindrical body portion.

3. The quick disconnect assembly of claim 2, wherein the one or more protrusions on the first end portion of the post defines a T-shape with the post body.

4. The quick disconnect assembly of claim 1, wherein the attachment point comprises a D-ring.

5. The quick disconnect assembly of claim 1, wherein the spring is configured as a wave spring.

6. The quick disconnect assembly of claim 1, wherein the post defines a threaded bore extending axially into the second end, and the attachment point includes a threaded rod configured to be secured to the post by threaded engagement between the threaded rod and the threaded bore.

7. The quick disconnect assembly of claim 1, wherein the post defines a threaded bore extending axially into the second end, wherein the attachment point defines a fastener opening extending axially therethrough, and wherein the assembly further comprises a fastener sized and configured to extend through the fastener opening in the attachment point and to engage the threaded bore to secure the attachment point to the post.

8. The quick disconnect assembly of claim 1, wherein the attachment point and the post comprise a single monolithic structure.

9. The adjustable stock of- claim 1, wherein the receptacle is part of a hand guard for a long gun.

10. The of claim 1, wherein the quick disconnect assembly is provided in a disassembled form.

11. A handguard for a long gun, comprising:

a quick disconnect assembly for a sling, comprising:

a cup having first end portion defining a through opening and a cylindrical body portion connected to and extending axially from the first end portion to a second end, the first end portion and the cylindrical body portion defining a through-opening axially through the first end portion and the cylindrical body portion, the through-opening having a cross-sectional shape of a circular region intersecting an elongated slot, the cup further defining a recess extending axially part way into the cylindrical body portion from the second end, the recess having a slot shape oriented transversely to the elongated slot of the through-opening;

a post extending axially between a first end portion and a second end, the first end portion of the post having a protrusion extending laterally outward, wherein the post is configured to pass through the through-opening when the post is in an unlocked position and the protrusion is configured to be received in the recess when the post is in a locked position;

an attachment point connected to the second end of the post;

a spring on the post between the attachment point and the cup; and a receptacle secured to the handguard, the receptacle defining a threaded opening configured to threadingly engage the cylindrical body portion of the cup.

12. The handguard of claim 11, wherein the attachment point comprises a D-ring pivotably attached to the second end of the post.

13. The handguard of claim 11, wherein the first end portion of the post defines a T-shape.

14. The handguard of claim 13, wherein a combination of the slot of the through-opening and the recess define a plus shape as viewed looking axially into the cylindrical body.

15. The handguard of claim 11, wherein the post defines a threaded bore extending into the second end and the attachment point includes a threaded rod, and wherein the attachment point can be secured to the post by threaded engagement between the threaded rod and the threaded bore.

16. The handguard of claim 11, wherein the second end of the cylindrical body is open.

17. An adjustable stock for a long gun, comprising:

a quick disconnect assembly for a sling, comprising:

a cup having first end portion defining a through opening and a cylindrical body portion connected to and extending axially from the first end portion to an open second end, the first end portion and the cylindrical body portion defining a non-circular through-opening, and the cylindrical body portion defining a recess extending axially part way into the cylindrical body portion from the open second end, wherein the cylindrical body portion is threaded;

a post extending axially between a first end portion and a second end, the first end portion of the post having one or more protrusions, wherein the first end portion of the post is configured to pass through the non-circular through-opening in the cup when the post is in a first rotational position and wherein the one or more protrusions are configured to be received in the recess when the post is in a second rotational position;

an attachment point on the second end of the post;

a spring on the post between the attachment point and the cup; and a receptacle secured to the adjustable stock, the receptacle defining a threaded opening configured to threadingly engage the cylindrical body portion.

* * * * *